US009315315B2

(12) United States Patent
Hanai et al.

(10) Patent No.: US 9,315,315 B2
(45) Date of Patent: Apr. 19, 2016

(54) REMAINDER REDUCING MEMBER

(75) Inventors: Nobuyuki Hanai, Tokyo (JP); Ken Ogata, Tokyo (JP); Hirokazu Shimizu, Tokyo (JP)

(73) Assignee: TOYO AEROSOL INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 14/239,563

(22) PCT Filed: Aug. 16, 2012

(86) PCT No.: PCT/JP2012/070802

§ 371 (c)(1),
(2), (4) Date: Feb. 19, 2014

(87) PCT Pub. No.: WO2013/031546

PCT Pub. Date: Mar. 7, 2013

(65) Prior Publication Data

US 2014/0197200 A1 Jul. 17, 2014

(30) Foreign Application Priority Data

Aug. 30, 2011 (JP) ..... 2011-187222

(51) Int. Cl.
*B65D 35/28* (2006.01)
*B65D 83/32* (2006.01)
*B65D 83/62* (2006.01)

(52) U.S. Cl.
CPC ..... *B65D 83/32* (2013.01); *B65D 83/62* (2013.01)

(58) Field of Classification Search
CPC .. B65D 83/32; B65D 83/62; B65D 2231/001; B65D 2231/002; B65D 2231/004; B05B 11/0043; B05B 15/005
USPC ..... 222/95, 464.1, 94, 92, 464.2; 239/337
See application file for complete search history.

(56) References Cited

U.S. PATENT DOCUMENTS 3,981,415 A * 9/1976 Fowler et al. ..... 222/95
4,148,416 A * 4/1979 Gunn-Smith ..... 222/94

(Continued)

FOREIGN PATENT DOCUMENTS

JP 6-286778 A 10/1994
JP 8-301332 A 11/1996

(Continued)

OTHER PUBLICATIONS

JP 08301332—English Translation, Machine Generated Feb. 2015.*

(Continued)

*Primary Examiner* — J. Casimer Jacyna
*Assistant Examiner* — Benjamin R Shaw
(74) *Attorney, Agent, or Firm* — Westerman, Hattori, Daniels & Adrian, LLP

(57) ABSTRACT

The present invention relates to a remainder reducing member with which a space with a circumference closed by a pressurized fluid is prevented from being generated and a final remaining amount of a discharged content is reduced. The remainder reducing member of the present invention has a simple structure, is manufactured with ease, easily installed at an inner side of an inner bag, and capable of discharging the content smoothly. The remainder reducing member, which is attached to the interior of the flexible inner bag disposed in aerosol container to reduce the final remaining amount of the discharged content, is constituted by a solid rod-shaped body and comprises an attachment portion attached to an inflow port of the inner bag such that said content can flow therein and a guiding portion provided with a plurality of guiding grooves formed in a lengthwise direction of an outer periphery thereof.

15 Claims, 10 Drawing Sheets

(56) References Cited

U.S. PATENT DOCUMENTS

| | | | | |
|---|---|---|---|---|
| 4,809,884 | A * | 3/1989 | Stackhouse | 222/153.04 |
| 4,953,753 | A * | 9/1990 | Gortz | 222/105 |
| 5,137,186 | A | 8/1992 | Moran | |
| 5,746,350 | A * | 5/1998 | Nishigami et al. | 222/95 |
| 2014/0008389 | A1 * | 1/2014 | Mekata et al. | 222/94 |

FOREIGN PATENT DOCUMENTS

| | | | |
|---|---|---|---|
| JP | 08301332 | A * | 11/1996 |
| JP | 9-48478 | A | 2/1997 |
| JP | 9-566 | U | 12/1997 |
| JP | 9-328177 | A | 12/1997 |
| JP | 2575410 | Y2 | 6/1998 |
| JP | 11-105893 | A | 4/1999 |
| JP | 2004-75099 | A | 3/2004 |
| JP | 2005-231644 | A | 9/2005 |

OTHER PUBLICATIONS

International Search Report dated Oct. 30, 2012 issued in corresponding application No. PCT/JP2012/070802.

* cited by examiner

Fig. 10

| FIRST | | FOLLOWING COMPLETE INJECTION (g) | FOLLOWING WASHING (g) | REMAINDER (g) | REMAINDER AVERAGE | | |
|---|---|---|---|---|---|---|---|
| DIP TUBE 100mm | F1 | 4.45 | 3.47 | 0.98 | F1 | F2 | F1+F2 |
| | F2 | 5.82 | 3.43 | 2.39 | 0.97 | 1.93 | 1.45 |
| | F1 | 4.38 | 3.48 | 0.90 | | | |
| | F2 | 5.54 | 3.35 | 2.19 | | | |
| | F1 | 4.53 | 3.49 | 1.04 | | | |
| | F2 | 4.59 | 3.38 | 1.21 | | | |
| REMAINDER REDUCING MEMBER (FIRST EMBODIMENT) 100mm | F1 | 4.36 | 3.67 | 0.69 | F1 | F2 | F1+F2 |
| | F2 | 5.45 | 3.62 | 1.83 | 0.49 | 1.46 | 0.99 |
| | F1 | 4.07 | 3.63 | 0.44 | | | |
| | F2 | 4.50 | 3.63 | 0.87 | | | |
| | F1 | 4.02 | 3.67 | 0.35 | | | |
| | F2 | 5.35 | 3.61 | 1.74 | | | |
| REMAINDER REDUCING MEMBER (FIRST EMBODIMENT) 85.5mm | F1 | 3.89 | 3.54 | 0.35 | F1 | F2 | F1+F2 |
| | F2 | 4.01 | 3.54 | 0.47 | 0.34 | 0.87 | 0.61 |
| | F1 | 3.98 | 3.60 | 0.38 | | | |
| | F2 | 4.22 | 3.54 | 0.68 | | | |
| | F1 | 3.88 | 3.59 | 0.29 | | | |
| | F2 | 5.03 | 3.57 | 1.46 | | | |
| REMAINDER REDUCING MEMBER (SECOND EMBODIMENT) 86mm | F1 | 3.91 | 3.44 | 0.47 | F1 | F2 | F1+F2 |
| | F2 | 4.37 | 3.44 | 0.93 | 0.47 | 0.90 | 0.68 |
| | F1 | 3.97 | 3.47 | 0.50 | | | |
| | F2 | 4.21 | 3.45 | 0.76 | | | |
| | F1 | 3.87 | 3.44 | 0.43 | | | |
| | F2 | 4.45 | 3.44 | 1.01 | | | |

REMAINDER REDUCING MEMBER

TECHNICAL FIELD

The present invention relates to a remainder reducing member that is attached to an interior of a flexible inner bag disposed in an interior of an aerosol container in order to reduce a final remaining amount of content to be discharged.

BACKGROUND ART

In a conventional aerosol container (see Patent Document 1 and so on, for example), a flexible inner bag is disposed integrally in an interior of an outer can, content to be discharged is stored in an inner bag, and a pressurized fluid is charged between the inner bag and an outer can. By pressing the flexible inner bag, the content housed in the inner bag is discharged to the outside through an inflow port.

In this type of aerosol container, the content does not come into contact with the pressurized fluid, and therefore any desired pressurized fluid can be used. Further, the pressurized fluid is not discharged together with the content, and therefore the content can be discharged efficiently.

When, in this type of aerosol container, a remaining amount of the content discharged from the flexible inner bag decreases, the inner bag becomes wrinkled or bent such that enclosed spaces are formed, and the content inevitably remains in these spaces to the last.

To reduce this final remaining amount, a dip tube is conventionally attached as a remainder reducing member so that the content can be discharged to the outside from both the vicinity of the inflow port and a tip end of the dip tube.

FIG. 8 shows a conventional aerosol container provided with a dip tube.

In this example, an inner bag 502 housing content F is provided in the interior of an outer can 501 of an aerosol container 500, and the inner bag 502 is provided with a spout 504 having a stem 505 in an upper portion thereof and an inflow port 503 opened in an interior thereof.

A pressurized fluid G such as nitrogen gas is charged into a space between the outer can 501 and the inner bag 502 such that when the stem 505 is pressed, the content housed in the inner bag 502 flows into the inflow port 503 so as to be discharged to the outside from a tip end of the stem 505.

Further, a dip tube 511 serving as a remainder reducing member is inserted into the inflow port 503, and at this time, an inner periphery of the inflow port 503 is formed such that a flow passage for the content F is secured between the inflow port 503 and the dip tube 511. Hence, as shown by arrows, the content F is guided in the direction of the stem 505 from both the vicinity of the inflow port 503 and the vicinity of a tip end of the dip tube 511, and then discharged to the outside.

In another conventional aerosol container shown in FIG. 9B, a plurality of flexible inner bags are disposed in a single outer can such that different types of content can be housed without intermixing and discharged simultaneously.

With this type of aerosol container, intermixing of the content prior to discharge can be prevented completely without the need to connect a plurality of outer cans or provide special internal structures. Further, the pressurized fluid need only be charged once into the single outer can, and therefore manufacture is easy (see Patent Document 2 and so on, for example).

Patent Document 1: Japanese Patent Application Publication No. 2004-75099 (all pages, all drawings)

Patent Document 2: Japanese Patent Application Publication No. 2005-231644 (all pages, all drawings)

Patent Document 3: Japanese Patent Application Publication No. H11-105893 (all pages, all drawings)

The content that inevitably remains in conventional aerosol containers such as those described in Patent Documents 1 and 2 can be reduced to a certain extent by providing the dip tube serving as the conventional remainder reducing member described above, and in so doing, the final remaining amount can be reduced. However, when an enclosed space forms in an intermediate position removed from both the vicinity of the inflow port and the tip end of the dip tube, the content still inevitably remains in the formed space. Moreover, content also remains in the interior of the dip tube.

Meanwhile, another conventional remainder reducing member for extracting content from a flexible container, albeit not an inner bag of an aerosol container, such that no content remains is constituted by a rigid rod-shaped body having a plurality of hollowed-out portions, which is disposed to extend from an inflow port into the interior of the container (see Patent Document 3 and so on, for example).

However, a conventional remainder reducing member such as that described in Patent Document 3 is constructed on the assumption that the flexible container is pressed from the outside by a human hand to guide the content toward the inflow port.

Hence, in an inner bag of an aerosol container, the entirety of which is pressed evenly by a pressurized fluid, content remaining in enclosed spaces cannot be guided to the inflow port by these remainder reducing members, and in fact, the enclosed spaces may be increased by projecting portions and hollowed-out portions provided on these conventional remainder reducing members, leading to an increase in the remaining amount.

Moreover, increasing a pressure of the pressurized fluid simply leads to an increase in a closing force exerted on the enclosed space, and does not therefore contribute to a reduction in the remaining amount of content.

DISCLOSURE OF THE INVENTION

It is therefore an object of the present invention to solve these problems in the conventional remainder reducing members described above by providing a remainder reducing member which is capable of preventing the formation of enclosed spaces due to a pressurized fluid so that a final remaining amount of content to be discharged can be reduced, which has a simple structure and is therefore easy to manufacture, which can be attached to an interior of an inner bag easily, and with which the content can be discharged smoothly to the last.

An invention according to claim 1 solves the problems described above by providing a remainder reducing member that is attached to an interior of a flexible inner bag disposed in an interior of an aerosol container in order to reduce a final remaining amount of content to be discharged, and that is constituted by a solid rod-shaped body , this remainder reducing member including: an attachment portion attached to an inflow port of the inner bag such that the content can flow therein; and a guiding portion provided with a plurality of guiding grooves formed in a lengthwise direction of an outer periphery thereof, wherein a sectional shape of a part formed with said guiding grooves is uniform in said lengthwise direction, and an overlap prevention portion is provided in an intermediate position of said guiding portion in said lengthwise direction, said overlap prevention portion being formed to have a sectional shape different from the shape of the part formed with said guiding grooves.

An invention according to claim 2 solves the problems described above by, in addition to the configuration of the remainder reducing member described in claim 1, providing the attachment portion on both ends of the guiding portion.

An invention according to claim 3 solves the problems described above by, in addition to the configuration of the remainder reducing member described in claim 1, forming the guiding portion in a columnar shape, and providing the guiding grooves in the outer periphery at 90° circumferential direction intervals.

An invention according to claim 4 solves the problems described above by, in addition to the configuration of the remainder reducing member described in claim 3, forming the guiding grooves with a V-shaped cross-section having a 90° contained angle, and forming the guiding portion with a cross-shaped cross-section.

An invention according to claim 5 solves the problems described above by, in addition to the configuration of the remainder reducing member described in claim 1, forming an end surface of the attachment portion in a smooth convex surface shape.

An invention according to claim 6 solves the problems described above by, in addition to the configuration of the remainder reducing member described in claim 1, forming end portion grooves between the attachment portion and the guiding portion in a perpendicular direction to the lengthwise direction.

An invention according to claim 7 solves the problems described above by, in addition to the configuration of the remainder reducing member described in claim 1, forming at least one discharge groove in a lengthwise direction in an outer periphery of the attachment portion.

An invention according to claim 8 solves the problems described above by, in addition to the configuration of the remainder reducing member described in claim 7, forming the attachment portion in a columnar shape, and providing the discharge grooves in the outer periphery at 180° circumferential direction intervals.

An invention according to claim 9 solves the problems described above by, in addition to the configuration of the remainder reducing member described in claim 1, forming intermediate grooves respectively between the overlap prevention portion and the guiding portion on either side thereof in a perpendicular direction to the lengthwise direction, and forming at least one connecting groove that connects the intermediate grooves on the respective sides and has a predetermined angle relative to the lengthwise direction in an outer periphery of the overlap prevention portion.

An invention according to claim 10 solves the problems described above by, in addition to the configuration of the remainder reducing member described in claim 9, forming the overlap prevention portion in a columnar shape, and providing the connecting grooves in the outer periphery in parallel at 180° circumferential direction intervals.

An invention according to claim 11 solves the problems described above by, in addition to the configuration of the remainder reducing member described in claim 1, forming the overlap prevention portion in a cylindrical shape such that a wall portion thereof adjacent to the guiding grooves bulges out toward the guiding grooves.

An invention according to claim 12 solves the problems described above by, in addition to the configuration of the remainder reducing member described in claim 11, forming the overlap prevention portion in a cylindrical shape, and providing a gate for use during injection molding in an interior of the cylindrical overlap prevention portion.

With the remainder reducing member according to the invention described in claim 1, when the remaining amount of the content decreases, the guiding portion having the plurality of guiding grooves formed in the lengthwise direction of the outer periphery functions as a passage for causing the content to flow toward the inflow port, and therefore formation of enclosed spaces due to a pressurized fluid can be prevented over an entire length of the remainder reducing member. As a result, a final remaining amount of the content to be discharged can be reduced.

Further, at a final stage of discharge of the content, the inner bag itself is deformed by pressure so as to enter the guiding grooves, and therefore the amount of content remaining in the guiding grooves is also extremely small. Hence, the amount of content remaining in the interior of the remainder reducing member itself can also be greatly reduced.

Moreover, the remainder reducing member has an extremely simple structure, and is therefore easy and inexpensive to manufacture and extremely easy to attach to the inflow port of the inner bag.

Furthermore, when a plurality of remainder reducing members are supplied together on attached to a container, since a sectional shape of two remainder reducing member is uniform in a lengthwise direction, it is possible to prevent a situation in which a part of the guiding grooves overlap and cannot be separated easily, by providing an overlap prevention portion. Therefore, the remainder reducing members can be extracted easily one at a time, thereby facilitating an attachment operation.

According to the configuration described in claim 2, either end portion of the remainder reducing member can be attached to the inflow port, thereby eliminating the need to align a lengthwise direction orientation thereof during manufacture, and as a result, the remainder reducing member can be attached easily.

According to the configuration described in claim 3, even when the remaining amount of the content decreases in a case where the inner bag is structured as a pouch formed by fusing together two sheets, for example, the guiding grooves function as a passage at all times, regardless of an axial attachment angle of the remainder reducing member, and therefore the attachment angle does not have to be determined during manufacture. As a result, the remainder reducing member can be attached easily.

According to the configuration described in claim 4, a capacity of the guiding grooves can be increased, and therefore the content can be discharged smoothly. Further, when the inner bag deforms due to pressure so as to enter the guiding grooves during the final stage, the capacity of the guiding grooves is greatly reduced, and therefore the amount of content remaining in the interior of the remainder reducing member itself can be drastically reduced.

Moreover, when molding the remainder reducing member using resin or the like, a complicated die structure is not required, and therefore the remainder reducing member can be manufactured easily, enabling a reduction in manufacturing cost.

According to the configuration described in claim 5, the attachment portion can be attached to the inflow port smoothly, and damage to the inner bag by a corner portion of the end surface of the attachment portion can be prevented.

According to the configuration described in claim 6, a flow passage can be secured for the content that has flowed into the guiding grooves to reach the inflow port via the end portion grooves, and therefore obstructions to the flow of the content due to an attachment structure for attaching the attachment portion to the inflow port can be avoided. As a result, the content can be discharged smoothly to the last.

According to the configuration described in claim 7, by providing the discharge grooves in a case where the attachment structure for attaching the attachment portion to the inflow port is fixed by inserting the attachment portion according to the present invention, in place of a conventional tube, into a cylindrical inflow port having content outflow grooves provided in an inner periphery thereof, for example, a content discharge amount can be secured even with the solid remainder reducing member, and as a result, the content can be discharged smoothly.

Further, in this case, the present invention can be attached without modifying a conventional attachment structure for attaching a tube to the inflow port.

According to the configuration described in claim 8, the content discharge amount can be secured. Moreover, a complicated die structure is not required to mold the remainder reducing member using resin or the like, and therefore the remainder reducing member can be manufactured easily, enabling a reduction in manufacturing cost.

According to the configuration described in claim 9, by providing the connecting groove that connects the intermediate grooves at a predetermined angle relative to the lengthwise direction, a lengthwise direction content flow passage is secured without being divided by the overlap prevention portion, and therefore the content can be discharged smoothly to the last.

According to the configuration described in claim 10, a content flow passage can be secured. Moreover, a complicated die structure is not required to mold the remainder reducing member using resin or the like, and therefore the remainder reducing member can be manufactured easily, enabling a reduction in manufacturing cost.

According to the configuration described in claim 11, a content flow passage can be secured. Moreover, the die structure employed to mold the remainder reducing member using resin or the like can be further simplified, and therefore the remainder reducing member can be manufactured even more easily, enabling a further reduction in manufacturing cost.

According to the configuration described in claim 12, by providing the gate for use during injection molding in the cylindrical interior, burrs formed on the gate can be prevented from contacting the inner bag. Hence, burr processing can be omitted without damaging the inner bag, and as a result, the remainder reducing member can be manufactured even more easily, enabling a further reduction in manufacturing cost.

BRIEF DESCRIPTION OF THE DRAWINGS

FIG. 10 shows results of a comparison experiment relating to a final remaining amount of content in the aerosol container of FIG. 9.

EXPLANATION OF REFERENCE NUMERALS

Figure 1:
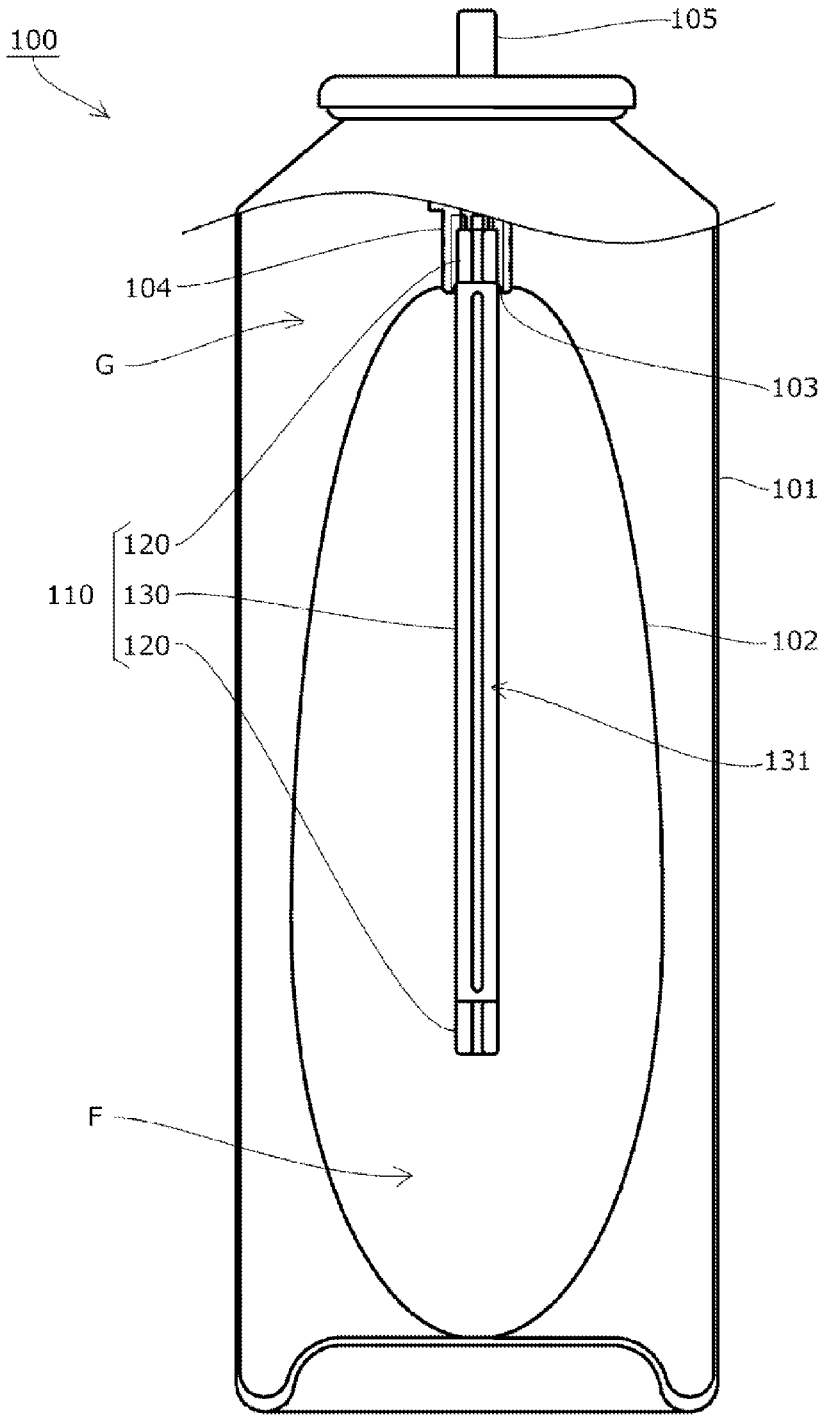
FIG. 1 is an illustrative sectional view of an aerosol container to which a remainder reducing member of a reference example is attached.

| | |
|---|---|
| 100, 500 | aerosol container |
| 101, 501 | outer can |
| 102, 502 | inner bag |
| 103, 503 | inflow port |
| 104, 504 | spout |
| 105, 505 | stem |
| 110, 210, 310 | remainder reducing member |
| 511 | dip tube (remainder reducing member) |
| 120, 220, 320 | attachment portion |
| 121, 221 | discharge groove |
| 122, 222 | end portion groove |
| 323 | end surface |
| 130, 230, 330 | guiding portion |
| 131, 231, 331 | guiding groove |
| 332 | wall portion |
| 240, 340 | overlap prevention portion |
| 241 | connecting groove |
| 242 | intermediate groove |
| F | content |
| G | pressurized fluid |

BEST MODE FOR CARRYING OUT THE INVENTION

Providing that a remainder reducing member according to the present invention is a remainder reducing member that is attached to an interior of a flexible inner bag disposed in an interior of an aerosol container in order to reduce a final remaining amount of content to be discharged, and is constituted by a solid rod-shaped body including: an attachment portion attached to an inflow port of the inner bag such that the content can flow therein; and a guiding portion provided with a plurality of guiding grooves formed in a lengthwise direction of an outer periphery thereof, wherein a sectional shape of a part formed with said guiding grooves is uniform in said lengthwise direction, and an overlap prevention portion is provided in an intermediate position of said guiding portion in said lengthwise direction, said overlap prevention portion being formed to have a sectional shape different from the shape of the part formed with said guiding grooves, whereby the remainder reducing member is capable of preventing the formation of enclosed spaces due to a pressurized fluid so that a final remaining amount of the content to be discharged can be reduced, has a simple structure and is therefore easy to manufacture, can be attached to the interior of the inner bag easily, and ensures that the content can be discharged smoothly to the last, there are no limitations on specific embodiments thereof.

First, the structure of reducing the final remaining amount of the content to be discharged will be described on basis of a reference example.

A remainder reducing member 110 serving as the reference example is inserted into an inflow port 103 of a similar aerosol container 100 to the conventional aerosol container 500 described above in place of the conventional dip tube 511.

More specifically, as shown in FIG. 1, an inner bag 102 housing content F is provided in an interior of an outer can 101 of the aerosol container 100, and the inner bag 102 is provided with a spout 104 having a stem 105 in an upper portion thereof and the inflow port 103, which is opened in an interior thereof.

A pressurized fluid G such as nitrogen gas is charged into a space between the outer can 101 of the aerosol container 100 and the inner bag 102 such that when the stem 105 is pressed, the content housed in the inner bag 102 flows into the inflow port 103 so as to be discharged to the outside from a tip end of the stem 105.

The remainder reducing member 110 serving as the first embodiment of the present invention, which includes an attachment portion 120 and a guiding portion 130, is inserted into the inflow port 103 of the inner bag 102.

At this time, an inner periphery of the inflow port 103 is formed such that a flow passage for the content F is secured between the inflow port 103 and the attachment portion 120 of the remainder reducing member 110.

Figure 2:
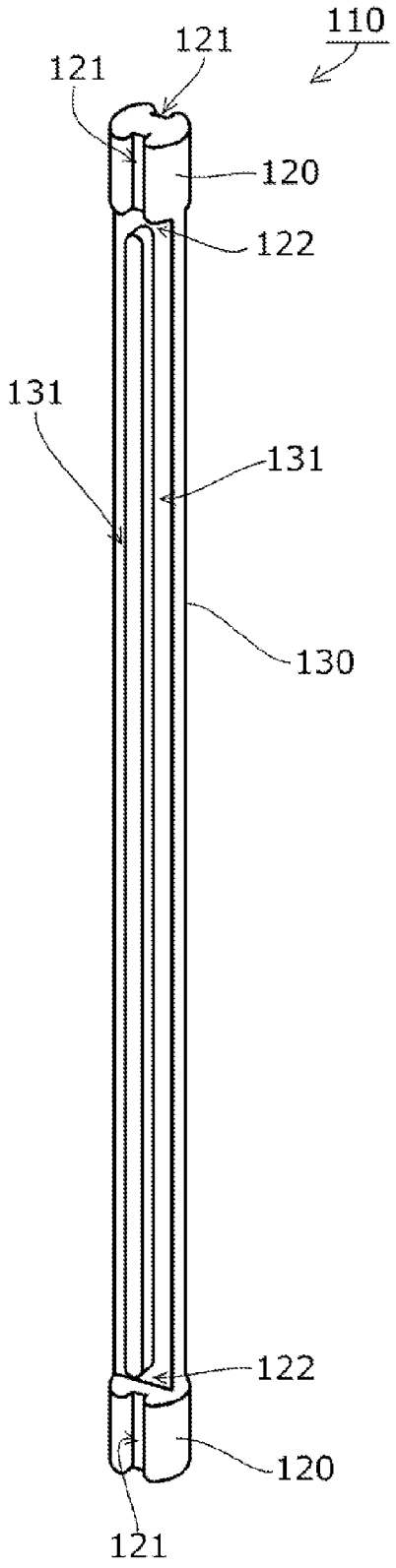
FIG. 2 is a perspective view of a remainder reducing member of the reference example.
Figure 3:
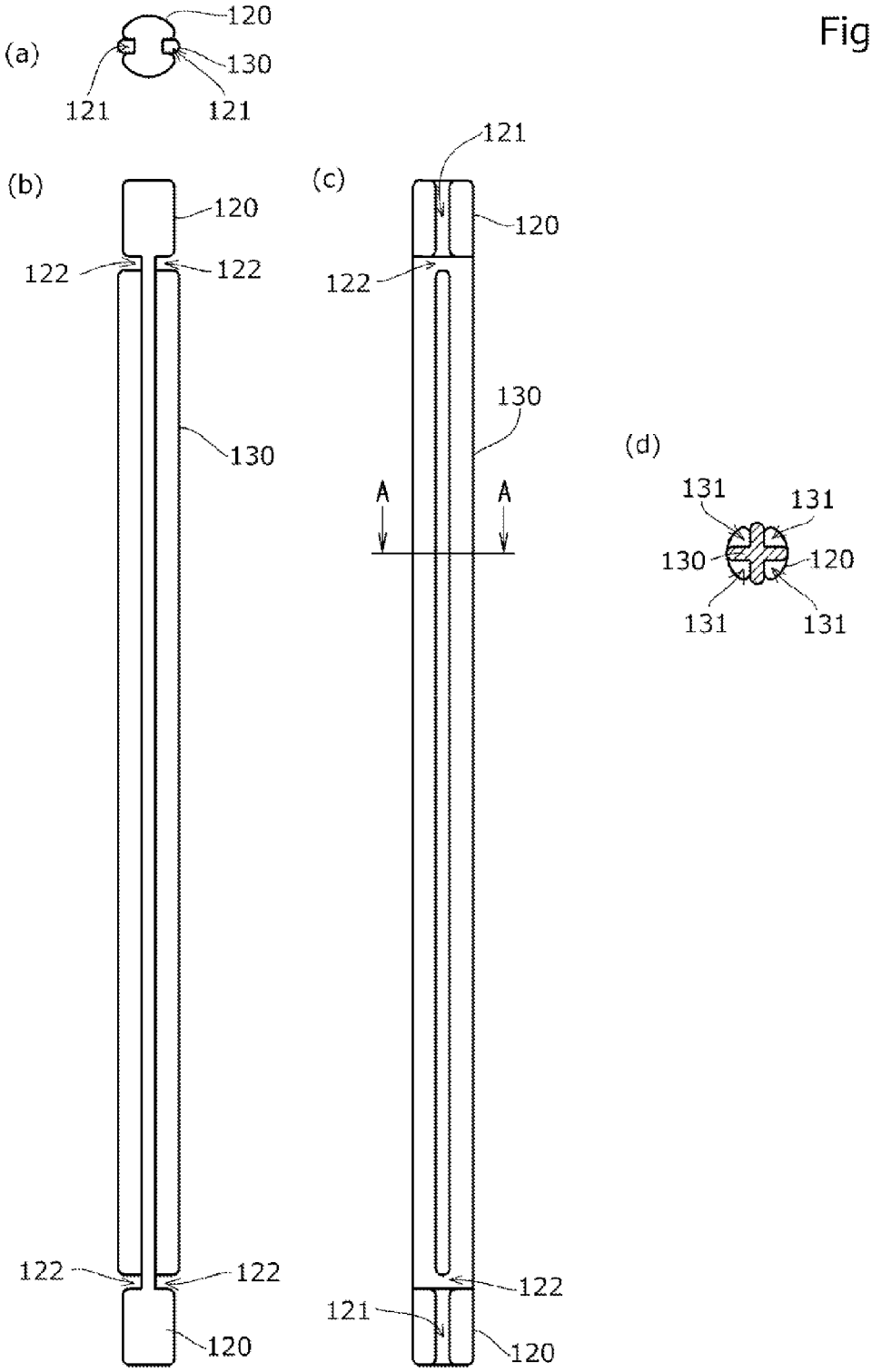
FIGS. 3A, 3B, 3C, and 3D are, respectively, a plan view, a front view, a side view, and an A-A sectional view of FIG. 2.

As shown in FIGS. 2 and 3, the remainder reducing member 110 is constituted by a solid rod-shaped body, and includes the attachment portion 120, which is provided on both end portions of the remainder reducing member 110 and can be attached to the inflow port 103 of the inner bag 102 such that the content F can flow therein, and the guiding portion 130, which is provided with a plurality of guiding grooves 131 formed in a lengthwise direction in an outer periphery thereof. Further, end portion grooves 122 are formed between the attachment portions 120 and the guiding portion 130 in a perpendicular direction to the lengthwise direction.

As shown in FIG. 3D, the lengthwise direction guiding grooves 131 provided in the guiding portion 130 are formed with a V-shaped cross-section having a 90° contained angle and provided in the outer periphery at 90° circumferential direction intervals. As a result of the guiding grooves 131, the guiding portion 130 has a cross-shaped cross-section.

Two discharge grooves 121 are provided in an outer periphery of the attachment portion 120 in a lengthwise direction at 180° circumferential direction intervals.

Operations and actions of the remainder reducing member 110 serving as the reference example, which is configured as described above, relating to discharge of the content F will now be described.

When the stem 105 is pressed, the content F housed in the inner bag 102 passes through the flow passage secured between the inflow port 103 and the attachment portion 120 of the remainder reducing member 110, and is then discharged to the outside from the tip end of the stem 105.

At this time, the two discharge grooves 121 are provided in the lengthwise direction of the outer periphery of the attachment portion 120, and therefore a discharge amount of the content F can be secured even when the remainder reducing member 110 serving as the reference example is inserted in place of the conventional dip tube 511. As a result, the content F can be discharged smoothly.

Moreover, the remainder reducing member 110 serving as the reference example can be attached without modifying a conventional attachment structure for attaching the dip tube 511 to the inflow port 503.

When a remaining amount of the content F housed in the inner bag 102 decreases, the inner bag 102 comes into contact with the guiding portion 130 of the remainder reducing member 110, but due to the existence of the guiding grooves 131, a lengthwise direction flow passage for the content F is secured to the last, and therefore the content F is guided to the inflow port 103 reliably through the end portion grooves 122 provided between the attachment portion 120 and the guiding portion 130.

Hence, the content F can be caused to flow toward the inflow port 103 from any location over an entire length of the remainder reducing member 110. Therefore, formation of enclosed spaces due to the pressurized fluid can be prevented, and as a result, the final remaining amount of the content F to be discharged can be reduced.

Further, at a final stage of discharge of the content F, the inner bag 102 is deformed by pressure so as to enter the guiding grooves 131, leaving only small spaces in the deepest portions, and therefore the amount of content F remaining in the guiding grooves 131 is extremely small. Hence, the amount of content F remaining in the interior of the remainder reducing member 110 itself can also be greatly reduced.

Note that in the reference example, the end portion grooves 122 provided between the attachment portions 120 and the guiding portion 130 are formed to have a horizontal line-shaped cross-section by cutting away opposing parts of the guiding portion 130 having a cross-shaped cross-section. However, the end portions grooves 122 may be formed to have a cross-shaped cross-section by reducing in size all parts of the guiding portion 130 having a cross-shaped cross-section.

Further, the number, width, depth, shape, and so on of the guiding grooves 131 may be set as desired in accordance with a shape and a material of the inner bag 102, a viscosity of the content F, and so on.

Furthermore, the number, width, depth, shape, and so on of the discharge grooves 121 provided in the attachment portion 120 may likewise be set as desired in accordance with the viscosity of the content F and so on.

With the configuration according to this embodiment, when the remainder reducing member 110 is manufactured from resin by injection molding or the like, the remainder reducing member 110 can be formed using only two simple dies. Hence, the remainder reducing member 110 can be manufactured easily, enabling a reduction in manufacturing cost.

First Embodiment

Figure 4:
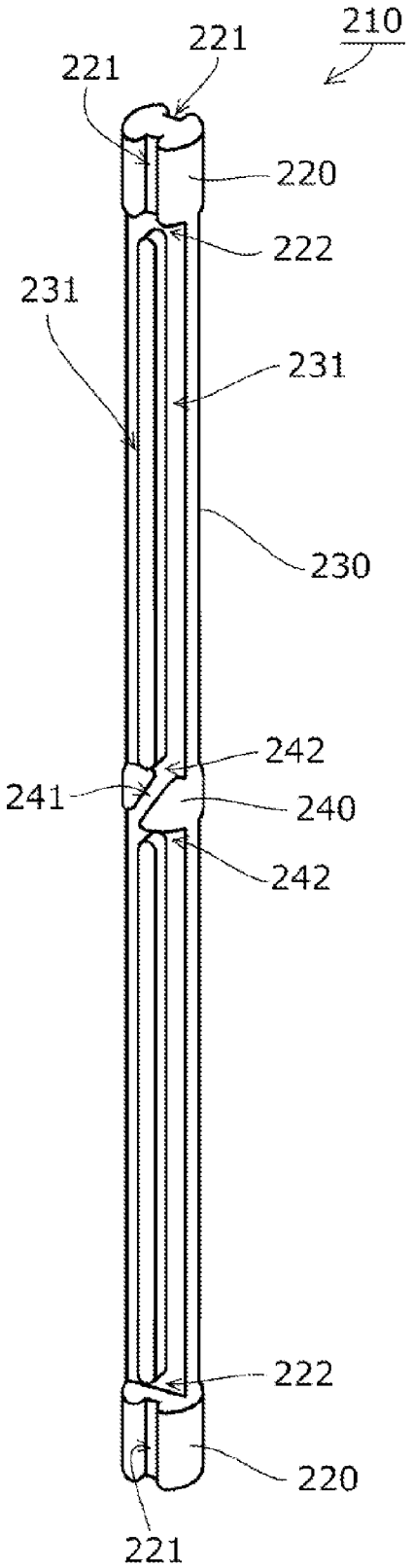
FIG. 4 is a perspective view of a remainder reducing member according to a first embodiment of the present invention.
Figure 5:
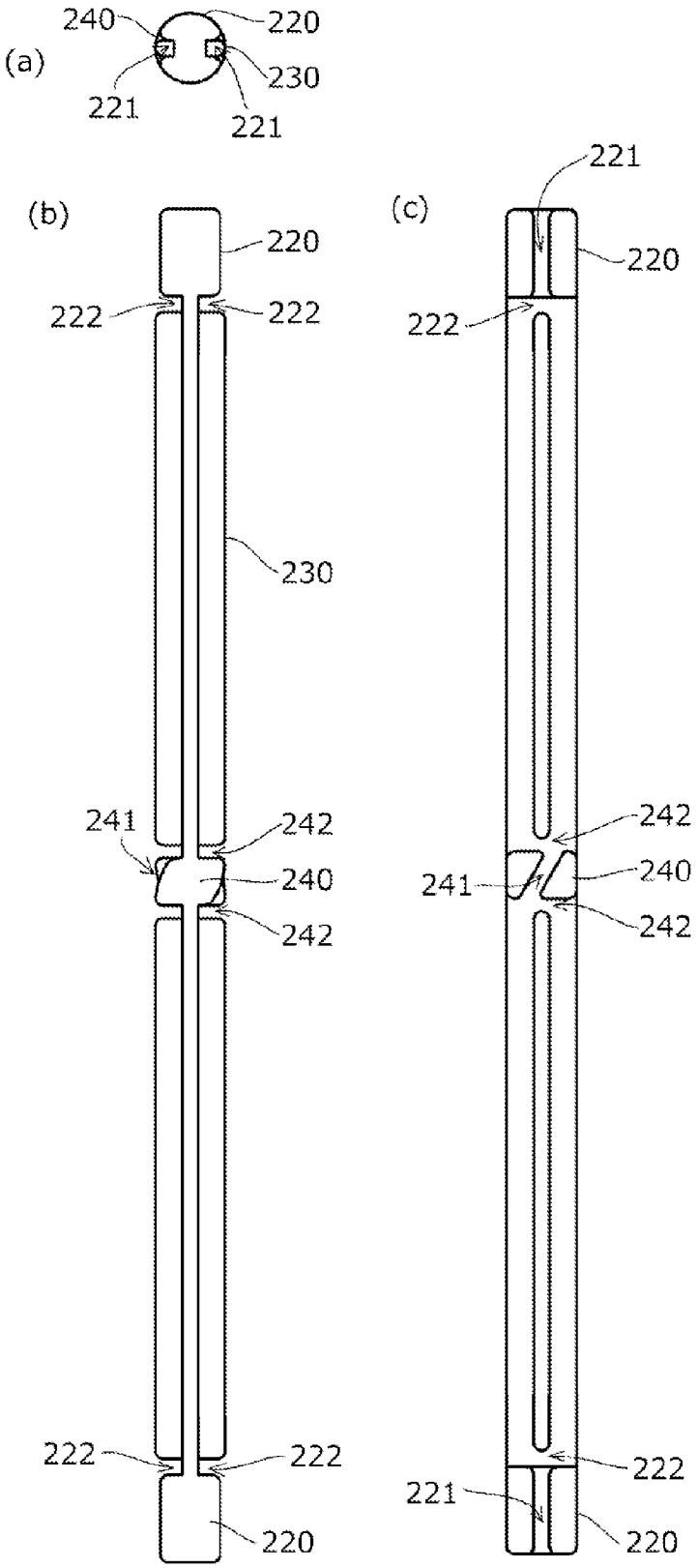
FIGS. 5A, 5B, and 5C are, respectively, a plan view, a front view, and a side view of FIG. 4.

As shown in FIGS. 4 and 5, in a remainder reducing member 210 serving as a first embodiment of the present invention, in addition to the configuration of the remainder reducing member 110 according to the reference example, an overlap prevention portion 240 is provided in an intermediate position in a lengthwise direction of a guiding portion 230.

More specifically, the remainder reducing member 210 serving as the first embodiment of the present invention is constituted by a solid rod-shaped body, and includes an attachment portion 220, which is provided on both end portions of the remainder reducing member 210 and can be attached to the inflow port 103 of the inner bag 102 such that the content F can flow therein, and the guiding portion 230, which is provided with a plurality of guiding grooves 231 formed in the lengthwise direction in an outer periphery thereof. Further, end portion grooves 222 are formed between the attachment portions 220 and the guiding portion 230 in a perpendicular direction to the lengthwise direction.

The lengthwise direction guiding grooves 231 provided in the guiding portion 230 are formed with a V-shaped cross-section having a 90° contained angle and provided in the outer periphery at 90° circumferential direction intervals. As a result of the guiding grooves 231, the guiding portion 230 has a cross-shaped cross-section.

Two discharge grooves 221 are provided in an outer periphery of the attachment portion 220 in the lengthwise direction at 180° circumferential direction intervals.

The overlap prevention portion 240 is provided in an intermediate position in the lengthwise direction of the guiding portion 230.

Intermediate grooves 242 are formed respectively between the overlap prevention portion 240 and the guiding portion 230 on both sides thereof in a perpendicular direction to the lengthwise direction, and connecting grooves 241 that connect the intermediate grooves 242 on the respective sides and have a predetermined angle relative to the lengthwise direction are provided in parallel in an outer periphery of the overlap prevention portion 240 at 180° circumferential direction intervals.

The connecting grooves 241 are provided at an offset phase relative to the guiding grooves 231 of the guiding portion 230.

Thus, in addition to the effects of the remainder reducing member 110 according to the reference example described before, by providing the overlap prevention portion 240, it is possible to prevent a situation in which two remainder reducing members 210 overlap and cannot be separated easily. Therefore, even when a plurality of remainder reducing members are supplied together, the remainder reducing members can be extracted easily one at a time, thereby facilitating an attachment operation.

Further, by providing the intermediate grooves 242 and the connecting grooves 241 in the overlap prevention portion 240, a lengthwise direction content flow passage constituted by the guiding grooves 231 of the guiding portion 230 on either side can be secured without being divided. As a result, the content F can be discharged smoothly to the last.

Note that the intermediate grooves 242, similarly to the end portion grooves 222 described above, are formed to have a horizontal line-shaped cross-section by cutting away opposing parts of the guiding portion 230 having a cross-shaped cross-section. Similarly to the end portions grooves 222, however, the intermediate grooves 242 may be formed to have a cross-shaped cross-section by reducing in size all parts of the guiding portion 230 having a cross-shaped cross-section.

Further, a number, a width, a depth, a shape, and so on of the intermediate grooves 242 may be set as desired in accordance with the shape and the material of the inner bag 102, the viscosity of the content F, and so on.

With the configuration according to this embodiment, when the remainder reducing member 210 is manufactured from resin by injection molding or the like, the remainder reducing member 210 can be formed using only two simple dies. Hence, the remainder reducing member 210 can be manufactured easily, enabling a reduction in manufacturing cost.

Second Embodiment

Figure 6:
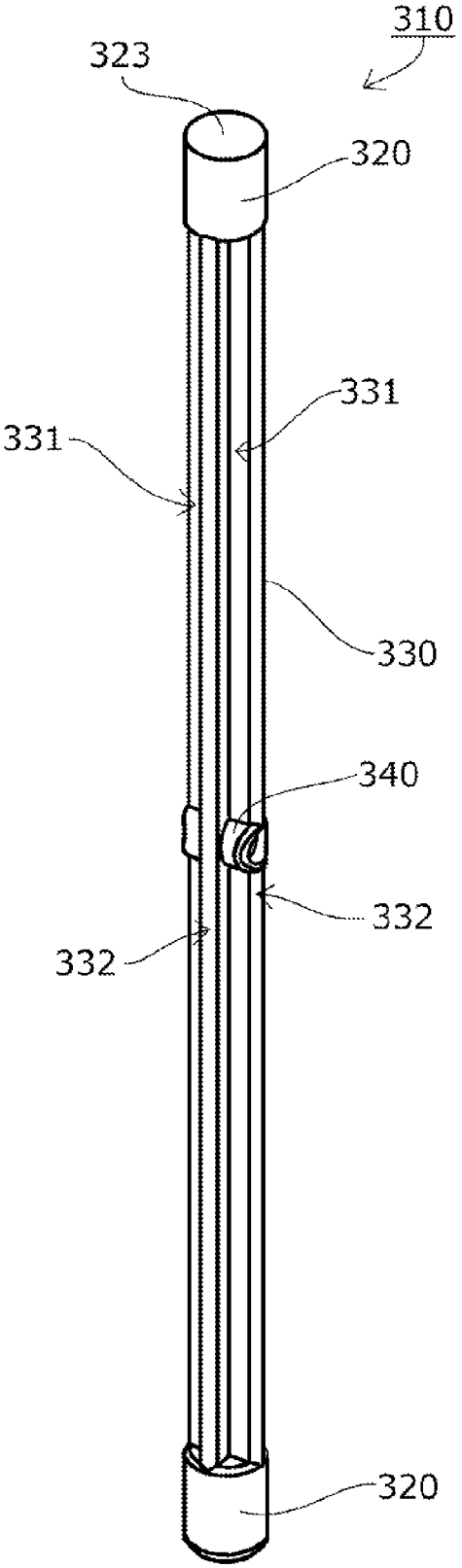
FIG. 6 is a perspective view of a remainder reducing member according to a second embodiment of the present invention.
Figure 7:
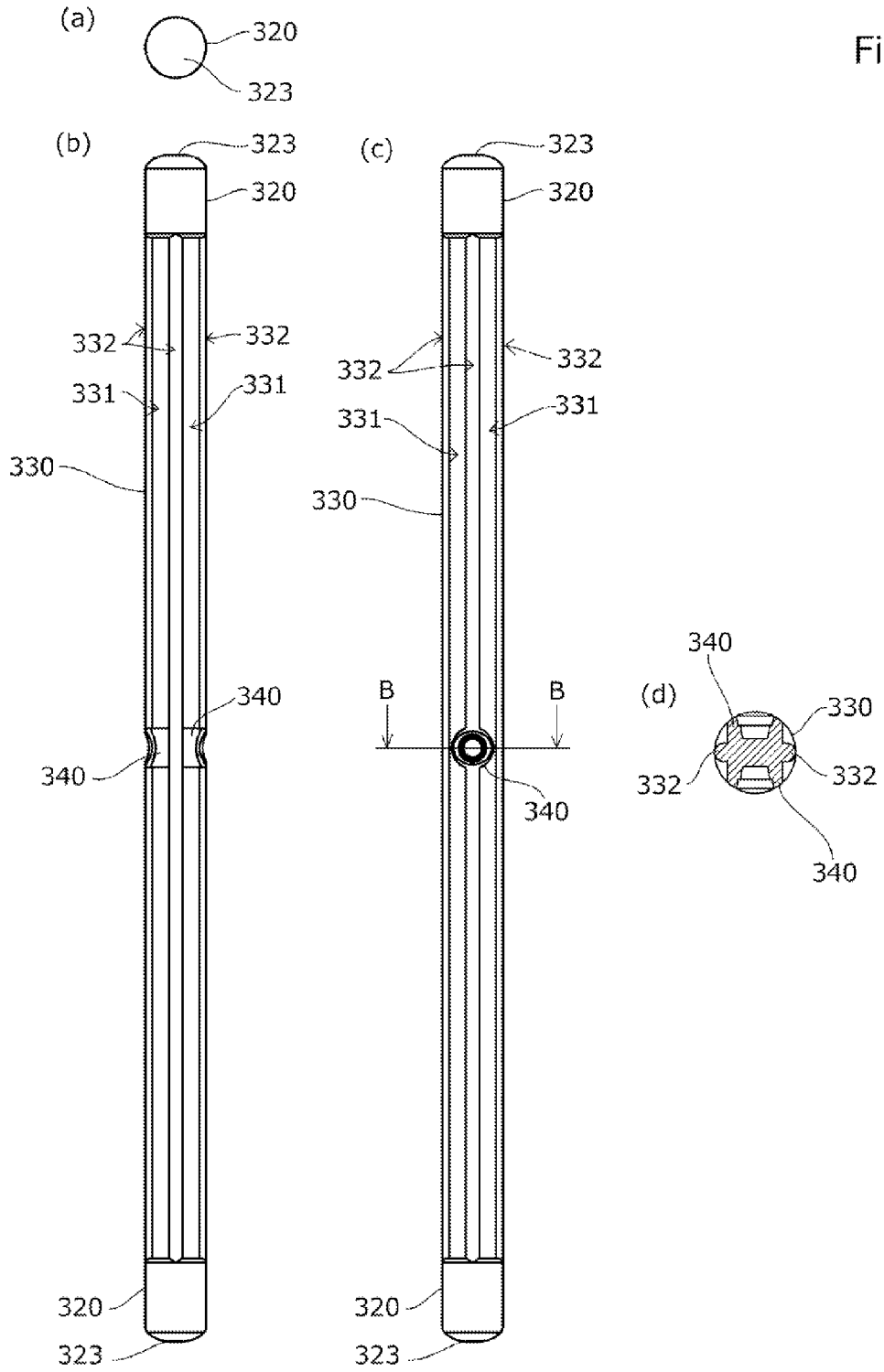
FIGS. 7A, 7B, 7C, and 7D are, respectively, a plan view, a front view, a side view, and a B-B sectional view of FIG. 6.
Figure 8:
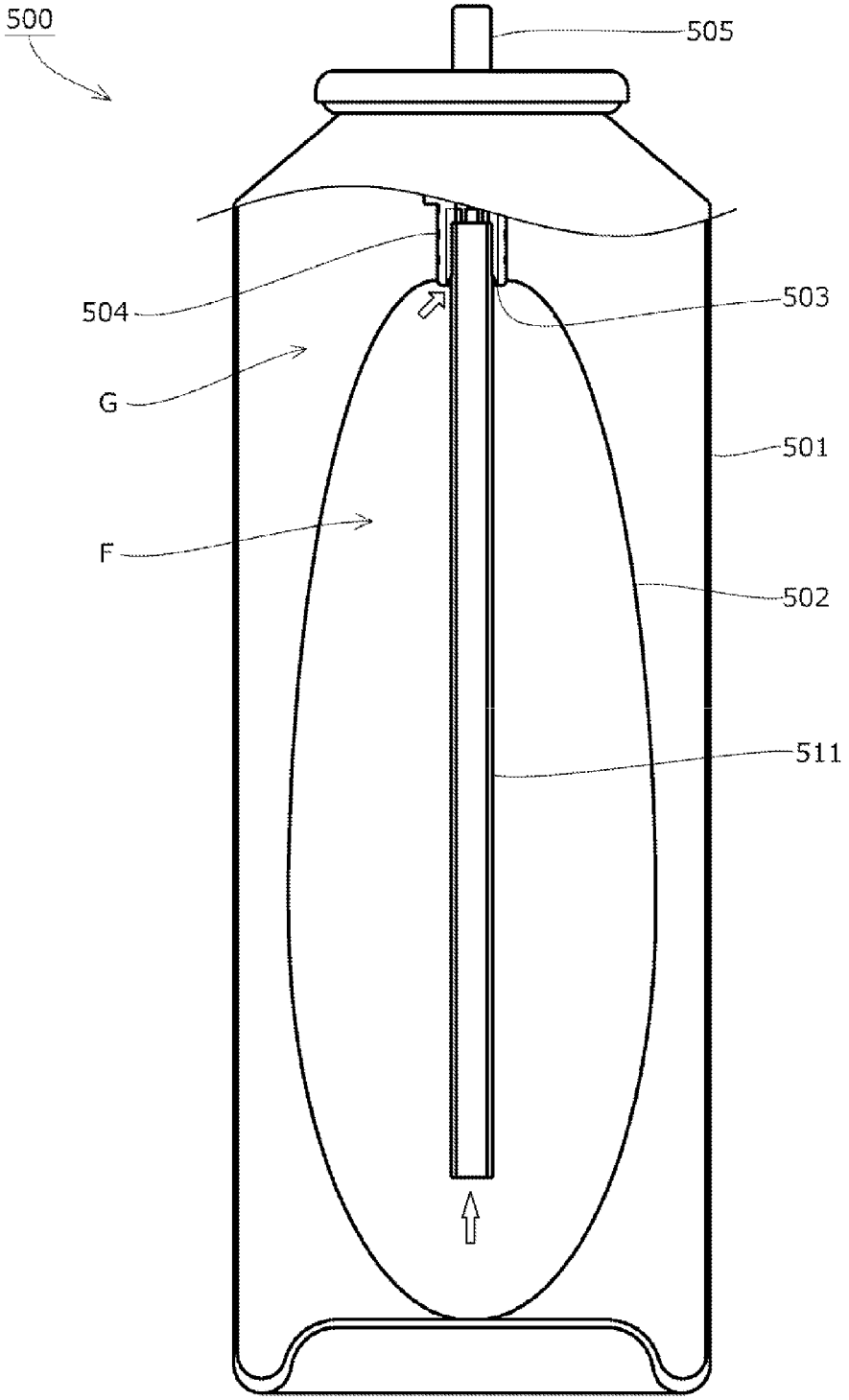
FIG. 8 is an illustrative sectional view of an aerosol container to which a conventional remainder reducing member (a dip tube) is attached.

As shown in FIGS. 6 and 7, a remainder reducing member 310 serving as a second embodiment of the present invention is constituted by a solid rod-shaped body, and includes an attachment portion 320, which is provided on both end portions of the remainder reducing member 310 and can be attached to the inflow port 103 of the inner bag 102 such that the content F can flow therein, and a guiding portion 330, which is provided with a plurality of guiding grooves 331 formed in a lengthwise direction in an outer periphery thereof.

Note that in this embodiment, the end portion grooves 122, 222 of the reference example and the first embodiment are not formed between the attachment portions 320 and the guiding portion 330.

The lengthwise direction guiding grooves 331 provided in the guiding portion 330 are formed with a V-shaped cross-section having a 90° contained angle and provided in the outer periphery at 90° circumferential direction intervals. As a result of the guiding grooves 331, the guiding portion 330 has a cross-shaped cross-section.

An end surface 323 of the attachment portion 320 is formed as a smooth convex curved surface that projects continuously from an outer periphery thereof.

Note that in this embodiment, the discharge grooves 121, 221 of the reference example and the first embodiment are not provided, but the remainder reducing member 310 is attached such that the content F can flow into the inflow port 103 of the inner bag 102 through groove portions provided in an inner surface of the inflow port 103.

An overlap prevention portion 340 is provided in an intermediate position in the lengthwise direction of the guiding portion 330.

The overlap prevention portion 340 is formed in a cylindrical shape by causing two opposing wall portions 332 of the guiding portion 330 having a cross-shaped cross-section to bulge out toward the guiding grooves 331 on either side thereof.

A diameter of a cylinder forming the overlap prevention portion 340 is set to be small enough not to block the guiding grooves 331, and therefore a lengthwise direction content flow passage is secured without being divided by the overlap prevention portion 340. As a result, the content F can be discharged smoothly to the last.

Further, by providing a gate in an interior of the cylinder forming the cylindrical overlap prevention portion 340 during injection molding, burrs remaining on the gate do not extend to the outside of the cylinder, and do not therefore damage the inner bag.

Results of a comparison experiment relating to final remaining amounts of content F1, F2 housed in respective inner bags when the remainder reducing members 210, 310 according to the first and second embodiments of the present invention and the conventional dip tube 511 are used in an aerosol container in which two inner bags are disposed in a single outer can will now be described.

Figure 9:
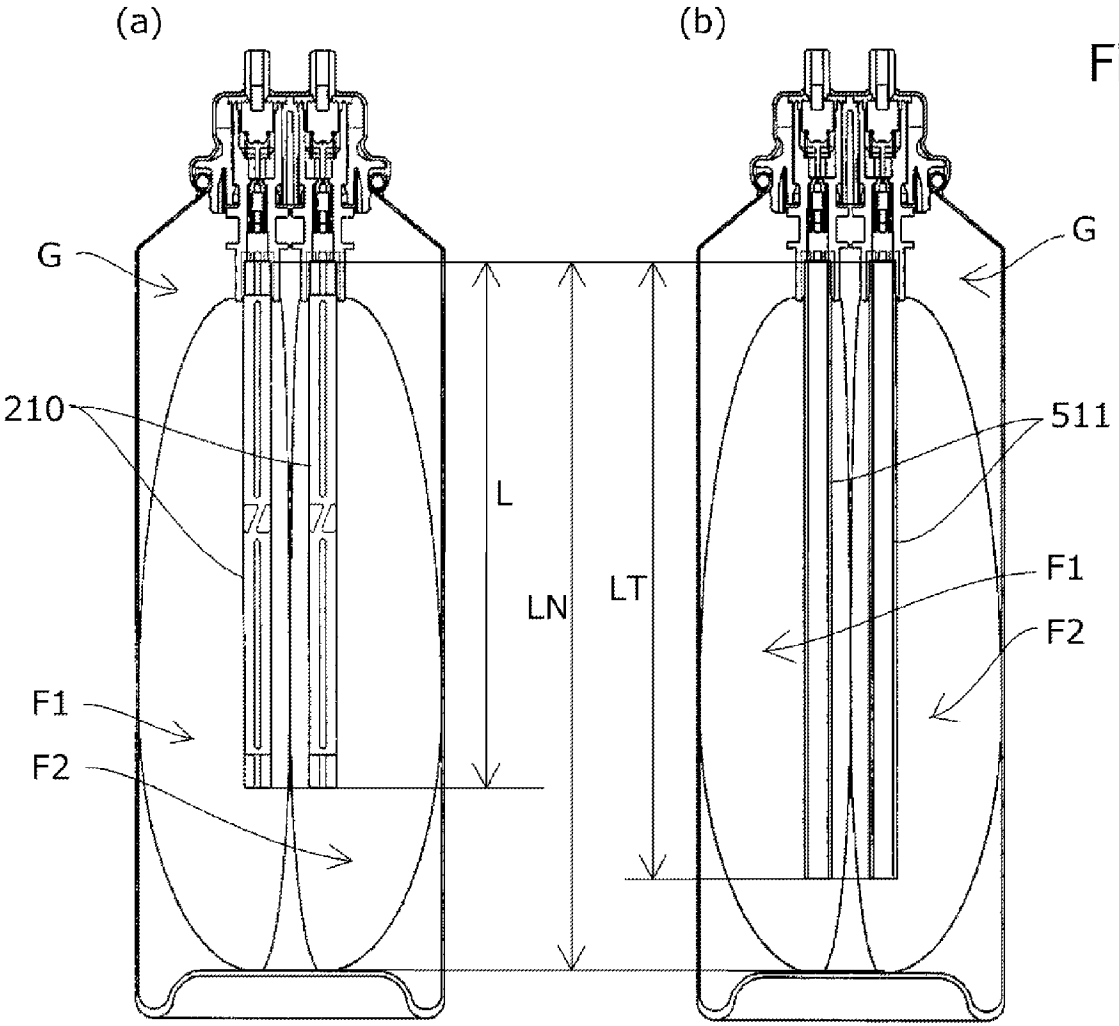
FIGS. 9A and 9B are illustrative sectional views showing, respectively, the remainder reducing member according to the present invention and a conventional remainder reducing member (a dip tube) attached to an aerosol container in which two inner bags are disposed in a single outer can.

As shown in FIG. 9, in the used aerosol container, a height LN from a charging apex portion of the remainder reducing member (dip tube) to a bottom portion of the inner bag was 114.9 mm, two liquid solutions constituting a two-liquid mixture type hair dye were housed in the respective inner bags as the content F1, F2, and nitrogen gas was charged between the outer can and the inner bags as the pressurized fluid G.

In a conventional example (shown in FIG. 9B), the dip tube 511, having a length LT of 100 mm, was inserted into the respective inner bags. In experiment examples according to the present invention, the remainder reducing member 210 serving as the second embodiment (shown in FIG. 9A) was inserted in two types having respective lengths L of 85.5 mm and 100 mm in place of the conventional dip tube 511, and the remainder reducing member 310 serving as the third embodiment (not shown), having a length L of 86 mm, was inserted in place of the conventional dip tube 511.

FIG. 10 shows results of an experiment in which measurement was performed three times in relation to each of the conventional dip tube 511 in which LT=100 mm, the two types of the remainder reducing member 210 serving as the first embodiment of the present invention having respective lengths L of 85.5 mm and 100 mm, and the remainder reducing member 310 serving as the second embodiment of the present invention, having a length L of 86 mm.

Shared conditions were as follows.

| | |
|---|---|
| Specific gravity: | |
| F1 | 0.999 to 1.001 (20° C.) |
| F2 | 0.999 to 1.001 (20° C.) |
| Viscosity: | |
| F1 | 10000 to 18000 mPa · s (25° C.) |
| F2 | 5000 to 12000 mPa · s (25° C.) |
| Initial stored amount: | |
| F1 | 60 g |
| F2 | 60 g |
| Pressure of charged nitrogen gas: | |
| 0.64 to 0.66 MPa (25° C.) | |

In both the conventional example and the respective experiment examples of the present invention, a difference between a weight of the inner bag in a normal use condition where the remainder reducing member (dip tube) was attached and discharge through the stem was complete (following complete ejection) and a weight of the inner bag after removing the content F1, F2 entirely by washing the interior of the inner bag (following washing) was set as the final remaining amount (remainder) of the content F1, F2.

As is evident from the experiment results, the final remaining amount of the content in the experiment examples relating to the remainder reducing members 210, 310 according to the present invention was smaller than that of the conventional example in almost all cases, excluding a few exceptions in experiment results relating to the low-viscosity content F2, and it can be seen from average values of the three measurements that with the two types of the remainder reducing member 210 according to the first embodiment of the present invention, having respective lengths L of 85.5 mm and 100 mm, and the remainder reducing member 310 according to the second embodiment of the present invention, having a length L of 86 mm, the final remaining amount can be reduced reliably in comparison with the conventional dip tube 511. On the basis of the above operations and actions relating to discharge of the content F, therefore, the content can be discharged smoothly to the last.

Moreover, as is evident from the experiment examples, the final remaining amount can be reduced in comparison with the conventional dip tube 511 when the slightly shorter remainder reducing members 210, 310 according to the present invention are used, and therefore an attachment process can be further simplified, leading to a further reduction in manufacturing cost.

INDUSTRIAL APPLICABILITY

As illustrated by the embodiments and experiment examples described above, the remainder reducing member according to the present invention may be used in an inner bag of a typical aerosol container having a single inner bag, an aerosol container having two inner bags housing different content, or an aerosol container having a large number of inner bags. Further, technical features of the present invention may be employed to design specific embodiments in accordance with various applications, and in this case, appropriate amendments may be implemented in accordance with an outer shape and application of the aerosol container.

Moreover, the present invention is not limited to an aerosol container, and may be used in a flexible container constructed on the assumption that the container is pressed from the outside by a human hand to guide content toward an inflow port, or a container having other pressing means.

The invention claimed is:

1. A remainder reducing member that is attached to an interior of a flexible inner bag disposed in an interior of an aerosol container in order to reduce a final remaining amount of content to be discharged, the remainder reducing member being constituted by a solid rod-shaped body and comprising:

an attachment portion attached to an inflow port of said inner bag such that said content can flow therein; and a guiding portion provided with a plurality of guiding grooves formed in a lengthwise direction of an outer periphery thereof, wherein a sectional shape of a part formed with said guiding grooves is uniform in said lengthwise direction, and an overlap prevention portion is provided in an intermediate position of said guiding portion in said lengthwise direction, said overlap prevention portion being formed to have a sectional shape different from the shape of the part formed with said guiding grooves, said overlap prevention portion extending into all of said plurality of guiding grooves at the same said intermediate position of said guiding portion in said lengthwise direction such as to prevent overlap of other remainder reducing members within all of said plurality of guiding grooves at the same said intermediate position.

2. The remainder reducing member according to claim 1, wherein said attachment portion is provided on both ends of said guiding portion.

3. The remainder reducing member according to claim 1, wherein said guiding portion is formed in a columnar shape, and said guiding grooves are provided in said outer periphery at 90° circumferential direction intervals.

4. The remainder reducing member according to claim 3, wherein said guiding grooves are formed with a V-shaped cross-section having a 90° contained angle, and said guiding portion is formed with a cross-shaped cross-section.

5. The remainder reducing member according to claim 1, wherein an end surface of said attachment portion is formed in a smooth convex surface shape.

6. The remainder reducing member according to claim 1, characterized in that end portion grooves are formed between said attachment portion and said guiding portion in a perpendicular direction to said lengthwise direction.

7. The remainder reducing member according to claim 1, wherein at least one discharge groove is formed in a lengthwise direction in an outer periphery of said attachment portion.

8. The remainder reducing member according to claim 7, wherein said attachment portion is formed in a columnar shape, and said discharge grooves are provided in said outer periphery at 180° circumferential direction intervals.

9. A remainder reducing member that is attached to an interior of a flexible inner bag disposed in an interior of an aerosol container in order to reduce a final remaining amount of content to be discharged, the remainder reducing member being constituted by a solid rod-shaped body and comprising:

an attachment portion attached to an inflow port of said inner bag such that said content can flow therein; and a guiding portion provided with a plurality of guiding grooves formed in a lengthwise direction of an outer periphery thereof, wherein a sectional shape of a part formed with said guiding grooves is uniform in said lengthwise direction, an overlap prevention portion is provided in an intermediate position of said guiding portion in said lengthwise direction, said overlap prevention portion being formed to have a sectional shape different from the shape of the part formed with said guiding grooves, intermediate grooves are formed respectively between said overlap prevention portion and said guiding portion on either side thereof in a perpendicular direction to said lengthwise direction, and at least one connecting groove that connects said intermediate grooves on said respective sides and has a predetermined angle relative to said lengthwise direction is formed in an outer periphery of said overlap prevention portion.

10. The remainder reducing member according to claim 9, wherein said overlap prevention portion is formed in a columnar shape, and said connecting grooves are provided in said outer periphery in parallel at 180° circumferential direction intervals.

11. The remainder reducing member according to claim 1, wherein said overlap prevention portion is formed in a cylindrical shape such that a wall portion thereof adjacent to said guiding grooves bulges out toward said guiding grooves.

12. The remainder reducing member according to claim 11, wherein said overlap prevention portion is formed in a cylindrical shape, and a gate provided in an interior of said cylindrical overlap prevention portion.

13. The remainder reducing member according to claim 1, wherein each said overlap prevention portion extends around substantially an entire circumference of a respective one of said remainder reducing members such as to prevent overlap at positions around said entire circumference.

14. A container, comprising:

a) an outer container body;

b) at least one flexible inner bag for containing dispensing content;

c) a pressurized fluid within said container surrounding said at least one inner bag;

d) a plurality of remainder reducing members that is located within said at least one flexible inner bag in order to reduce a final remaining amount of the content to be discharged, each of said remainder reducing member being constituted by a solid rod-shaped body and comprising:

an attachment portion attached to an inflow port of said inner bag such that said content can flow therein; and a guiding portion provided with a plurality of guiding grooves formed in a lengthwise direction of an outer periphery thereof, wherein a sectional shape of a part formed with said guiding grooves is uniform in said lengthwise direction, and an overlap prevention portion is provided in an intermediate position of said guiding portion in said lengthwise direction, said overlap prevention portion being formed to have a sectional shape different from the shape of the part formed with said guiding grooves, said overlap prevention portion extending into all of said plurality of guiding grooves at the same said intermediate position of said guiding portion in said lengthwise direction such as to prevent overlap of other remainder reducing members within all of said plurality of guiding grooves at the same said intermediate position; and e) wherein said plurality of remainder reducing members are aligned side-by-side substantially parallel to one another within said container with said overlap prevention portions of each said remainder reducing member being adjacently located at a same height within said container and preventing overlap between said plurality of remainder reducing members.

15. The remainder reducing member according to claim 14, wherein each said overlap prevention portion extends around substantially an entire circumference of a respective one of said remainder reducing members such as to prevent overlap at positions around said entire circumference.

* * * * *